US005293822A

United States Patent [19]

Peddie

[11] Patent Number: 5,293,822

[45] Date of Patent: Mar. 15, 1994

[54] DEFENSIVE SHOOTING PROJECTILE

[76] Inventor: David S. Peddie, 405 S. Princeton, Itasca, Ill. 60143

[21] Appl. No.: 910,741

[22] Filed: Jul. 8, 1992

[51] Int. Cl.[5] ..... F42B 12/00; F42B 12/62

[52] U.S. Cl. ..... 102/506; 102/448; 102/494; 102/517

[58] Field of Search ..... 102/389, 398, 448, 455, 102/457, 494, 495, 496, 497, 501, 506, 517, 518, 529, 438, 439, 489, 513

[56] References Cited

U.S. PATENT DOCUMENTS

| | | | |
|---|---|---|---|
| 949,063 | 2/1910 | Dorn | 102/455 |
| 2,766,692 | 10/1956 | Mynes | 102/506 |
| 3,911,820 | 10/1975 | Cannon | 102/438 |

FOREIGN PATENT DOCUMENTS

| | | | |
|---|---|---|---|
| 191539 | 10/1907 | Fed. Rep. of Germany | 102/506 |
| 1124740 | 10/1956 | France | 102/506 |
| 1331767 | 5/1963 | France | 102/506 |
| 23798 | 6/1911 | United Kingdom | 102/494 |

*Primary Examiner*—Harold J. Tudor

[57] ABSTRACT

This invention, a projectile, when used in standard issue handguns, rifles and shotguns was designed to address the problem of over penetration and possible ricochet when used in law enforcement work. The projectile comprises a hollow tubular body having releasable end seals and containing lead shot.

The problem, is that many projectiles, even those designed to loose their energy in human/animal tissue like living organisms, may also penetrate inanimate like substances, causing unnecessary damage to property, and even worse injury or death to innocent bystanders. This projectile is designed to significantly lessen that possibility.

3 Claims, 3 Drawing Sheets

DEFENSIVE SHOOTING PROJECTILE

BACK GROUND OF THE INVENTION

When a projectile is fired from a firearm it has stored kinetic energy. It is imperative that the projectile be able to release this energy or force within the first object it strikes.

The reason becomes apparent in the example of a police officer attempting to restrain a fleeing felon. If the police officer discharges his weapon and fails to clearly hit his target, the possibility of a ricochet injuring an innocent bystander is possible.

It is essential that a projectile shatter upon impact, and release all its energy, rather than passing through.

DESCRIPTION OF PRIOR ART

Past art, has found that a projectile made with smaller sub parts inside of its main body, held in place by a cap or epoxy will, upon hitting target, come apart and thus into pass through the target, releasing its stored energy.

A major draw back in prior art, is that sometimes the projectile, upon hitting a target, fails to open because it si forced closed. If this happens, the projectile will penetrate deeper into the target, possibly passing through, with much of its energy still in it.

The projectile in this present invention has two openings; one in its front, and also a second opening at its back. Both opening's present a means for the energy and pellets inside to be released. Upon impact, the pellets will be released in a more positive and controllable manner, because they will have two paths or outlets

SUMMARY

The primary objective of this invention is to provide law enforcement personal, and others, with an improved projectile, with particular regard for safety. This is accomplished by providing a projectile with a higher probability of releasing all its energy into the target. This projectile, with tow ends which can easily be forced open to release its energy is an improvement over a projectile with only one end which can be forced open. Because both ends can not hit an object at the same time, when one end is forced closed on impact, this action forces the other end to open. If the projectile hits a object on its side, both ends or caps will be forced open at the same time. The design of this projectile will reduce the possibility of a ricochet hurting innocent bystanders.

BRIEF DESCRIPTION OF THE DRAWING FIGURES

The figures in the drawings are briefly described as follows.

DETAILED DESCRIPTION OF THE DRAWING FIGURES

Figure 1:
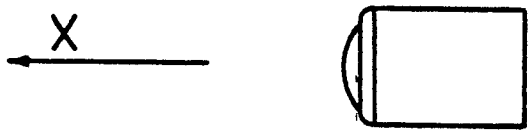
FIG. 1 is a side view of the (projectile) invention.

FIG. 1 is a side view of a complete projectile. Arrow X is to the front of the projectile showing its direction of travel. The internal parts of this invention are best understood by FIG. 2.

Figure 2:
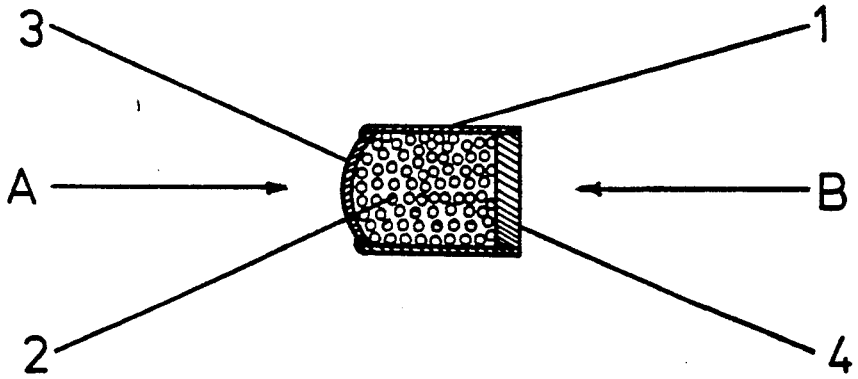
FIG. 2 is a cross-sectional view of a completed projectile showing all of the internal parts.

FIG. 2 shows a complete projectile with A as its front, and B its back. A copper cylindrical tube 1, which makes up the main body, and the lead shot 2, which will be released upon impact. The front cap 3, and the back cap 4, are made of soft plastic or thin metal which will hold the front and rear of the projectile closed retaining the lead shot and protecting the projectile from acceleration pressures and temperatures. Both the front and rear caps are made f material which will break free upon impact releasing the projectiles lead shot.

Figure 3A:
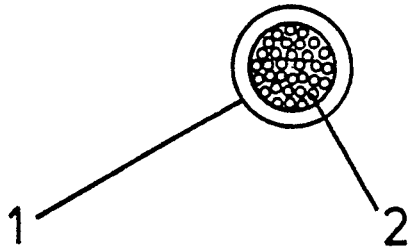
FIGS. 3A and 3B are a top and bottom views of a completed projectile.
Figure 3B:
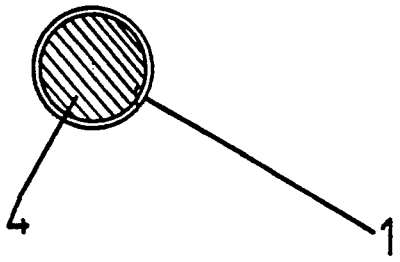

FIG. 3A is a top view of the projectile, with the lead shot 2, shown under a clear plastic cap, for clarification only. The bottom view is shown in FIG. 3B with the back cap 4, in place.

Figure 4:
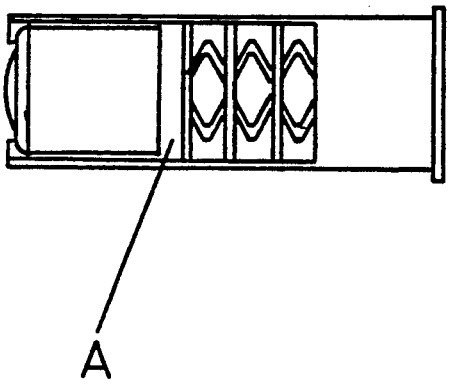
FIGS 4,5,6 are drawings of examples of how the projectile would be used in different cartridges. Shown are shotgun, rifle and handgun cartridges.

FIG. 4 is an example of the projectile in a shot gun cartridge. Note . . . the use of a shotgun wad (A) around the projectile to protect the projectiles's base and to center the projectile as it passes down the shotguns's bore. In addition, in the case of rifle or handgun cartridges a gas check (plug) would be behind the projectile to protect its base from hot gases.

Figure 5:
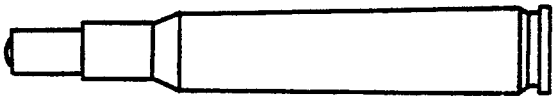

FIG. 5 is an example of a rifle cartridge and could be designed for most any popular rifle.

Figure 6:
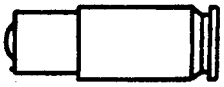

FIG. 6 is an example of how the projectile could be used in a handgun cartridge.

Figure 7:
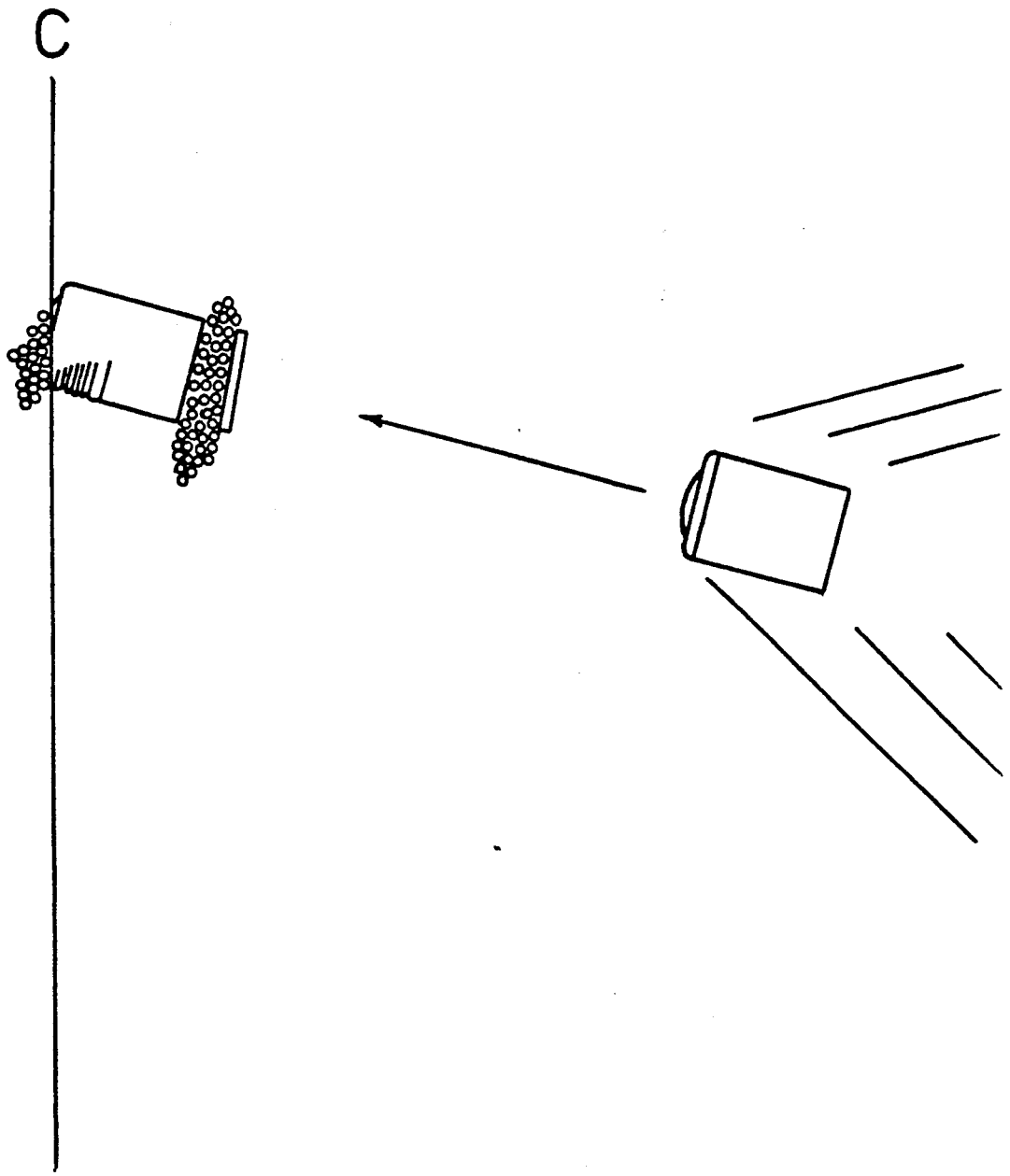
FIG. 7 is a drawing of the projectile striking a wall and the results.

FIG. 7 is an example of the projectile striking a solid object. In this case (C) being a brick wall reflecting the results upon impact. The impact causes the projectile to come apart releasing its kinetic energy in a positive controlled manner. The front cap is forced open releasing the shot in its main body. In addition, the back cap is forced open also releasing the remaining energy simultaneously.

In the event the front cap fails to open because of damage, the resulting pressure on the front of the main body will ensure that the lead shot and back cap would be forced out, thereby releasing the projectiles energy in a positive manner.

I claim:

1. A projectile for firearms comprised of a main body in the form of a hollow cylinder, enclosing particles of lead shot with the projectiles front end closed, with a releasable front seal, to contain the lead shot and the projectiles back end closed, with a releasable back seal, to contain the lead shot assuring the projectile will travel completely together to a target, and upon impact with either an inanimate object or human tissue will break its front seal, back seal, or both seals releasing the lead shat.

2. A projectile as defined in claim 1 wherein the front seal is held in place by a crimp.

3. A projectile as defined in claim 1 wherein the back seal shield in place by a friction fit.

* * * * *